US009673562B2

(12) United States Patent
Perot et al.

(10) Patent No.: US 9,673,562 B2
(45) Date of Patent: Jun. 6, 2017

(54) SEALED PLUG CONNECTOR

(71) Applicant: DELPHI INTERNATIONAL OPERATIONS LUXEMBOURT S.A.R.L., Bascharage (LU)

(72) Inventors: Aymeric Perot, Epernon (FR); Erwan Guillanton, Epernon (FR)

(73) Assignee: Delphi International Operations Luxembourg SARL, Luxembourg (LU)

( * ) Notice: Subject to any disclaimer, the term of this patent is extended or adjusted under 35 U.S.C. 154(b) by 0 days.

(21) Appl. No.: 15/189,161

(22) Filed: Jun. 22, 2016

(65) Prior Publication Data

US 2017/0012381 A1 Jan. 12, 2017

(30) Foreign Application Priority Data

Jul. 6, 2015 (FR) ..... 15 56402

(51) Int. Cl.

| | |
|---|---|
| ***H01R 13/52*** | (2006.01) |
| ***H01R 4/30*** | (2006.01) |
| ***H01R 9/24*** | (2006.01) |
| ***H01R 13/53*** | (2006.01) |

(52) U.S. Cl.

CPC ..... *H01R 13/5202* (2013.01); *H01R 4/308* (2013.01); *H01R 9/2491* (2013.01); *H01R 13/521* (2013.01); *H01R 13/53* (2013.01); *H01R 13/5219* (2013.01); *H01R 2201/26* (2013.01)

(58) Field of Classification Search

CPC ..... H01R 13/5202; H01R 9/2491

See application file for complete search history.

(56) References Cited

U.S. PATENT DOCUMENTS

| | | | | |
|---|---|---|---|---|
| 5,902,150 | A * | 5/1999 | Sigl | B23K 9/323 439/587 |
| 2004/0183650 | A1* | 9/2004 | Stitz | H01F 7/06 338/192 |
| 2010/0084205 | A1* | 4/2010 | Tarchinski | B60K 6/46 180/65.1 |
| 2013/0014986 | A1* | 1/2013 | Ko | H01R 43/20 174/520 |
| 2013/0164976 | A1* | 6/2013 | Chastain | H01R 9/05 439/583 |

(Continued)

FOREIGN PATENT DOCUMENTS

| | | |
|---|---|---|
| EP | 1191637 A1 | 3/2002 |
| GB | 2497331 A | 6/2013 |

(Continued)

*Primary Examiner* — James Harvey
(74) *Attorney, Agent, or Firm* — Robert J. Myers

(57) ABSTRACT

The invention concerns a plug connector for a high current device, intended to be placed in particular in the engine compartment of a motor vehicle. A device such as a printed circuit board housed in the plug connector is connected to a cable via at least one rigid conductive metal bar (bus bar). A ring is interposed between the rigid conductive metal bar and a terminal electrically connected to the cable. A bolt holds the terminal, the ring and the bus bar clamped together. To ensure the seal of the plug connector at the bolt, a first ring seal is placed between the ring and an unthreaded zone of the shank of the bolt, and a second seal is placed between the ring and the plug connector.

6 Claims, 2 Drawing Sheets

(56) References Cited

U.S. PATENT DOCUMENTS

| | | | | |
|---|---|---|---|---|
| 2013/0203284 | A1* | 8/2013 | Perotto | B29C 45/14639 439/530 |
| 2015/0280354 | A1* | 10/2015 | Rangi | H01R 13/5202 439/587 |
| 2016/0087371 | A1* | 3/2016 | Eom | H01R 13/5205 439/587 |
| 2016/0141793 | A1* | 5/2016 | Osada | H01R 13/5216 439/587 |
| 2017/0012381 | A1* | 1/2017 | Perot | H01R 4/308 |

FOREIGN PATENT DOCUMENTS

| | | | |
|---|---|---|---|
| WO | 2012161297 | A1 | 11/2012 |
| WO | 2014092629 | A1 | 6/2014 |

* cited by examiner

SEALED PLUG CONNECTOR

CROSS-REFERENCE TO RELATED APPLICATION

This application claims the benefit under 35 U.S.C. §119 (a) of Patent Application No. 1556402 filed in the Institut National de la Propriété Industrielle (French Patent Office) on Jul. 6, 2015, the entire disclosure of which is hereby incorporated by reference.

TECHNICAL FIELD OF THE INVENTION

The invention concerns the field of motor vehicles, and more particularly the field of plug connectors for high current devices.

BACKGROUND OF THE INVENTION

High current circuits (up to 200 amperes for example) have been developed by the automotive industry, for example for hybrid vehicles and for automatic starting and stopping devices for the engine when the vehicle has stopped (i.e. a "start & stop system"), etc.

These circuits sometimes include components placed in the engine compartment and it is therefore necessary for these to be highly effectively protected from environmental contaminants such as moisture or splashing liquid. To this end, certain components are placed in plug connectors and these plug connectors must comply with International Protection Code specifications of type IP9K and IPx7 (International Electrotechnical Commission Standard 60529). In other words, they must be sufficiently sealed to pass the water splash and water immersion tests.

The areas in which the current passes between firstly the circuits and devices housed in a plug connector and secondly a circuit, wiring harness or loom outside the plug connector must therefore allow conduction of high current intensities while forming a sufficiently water-tight barrier to meet the above-mentioned requirements.

To this end, sealed connectors are generally used. However, a more economical solution than the use of sealed connectors remains to be desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment of the invention, a plug connector accommodating at least one high current conduction element is provided. Such an element is for example a rigid metal bar (also called a "bus bar"), but may also be a braid fitted with a terminal, a shunt or other element suitable for the conduction of current at the intensity level required by the application for which the plug connector is used. The plug connector also includes an electrically conductive metal ring housed in a cavity arranged in a wall of the plug connector. This ring includes a lower surface oriented towards the inside of the plug connector and in electrical contact with the high current conduction element. For example, the ring takes the form of a hollow cylinder with a lower surface and an upper surface substantially perpendicular to the longitudinal axis of the cylinder. The respective surfaces of the ring and the high current conduction element in contact with each other are firmly applied against each other, in order to ensure a good conduction of current between the two parts.

Also, a water-tight barrier is created between a peripheral surface of the ring and the cavity in which it is housed. For example, if the ring is cylindrical, it includes a convex cylindrical outer surface, and the cavity in which it is housed includes a concave cylindrical inner surface. The seal between the two cylindrical surfaces may therefore be ensured by close contact between the two (obtained by moulding the plug connector over the ring for example) or by interposing a seal between them. For example, the outer peripheral cylindrical surface of the ring includes an outer groove accommodating a ring seal in contact with both the ring and a surface of the plug connector.

The plug connector may also include one or more of the following characteristics considered in isolation or in combination with one or more others:

- the ring is threaded onto a pin which is mechanically connected to the high current conduction element; in this case, a water-tight barrier may be created between an inner surface of the ring and the pin; thus an outer cylindrical surface of the pin may include a groove accommodating a ring seal in tight contact with both the ring and the pin;
- the pin is force-mounted and/or mounted by means of clips or other retention means on the high current conduction element;
- the ring may occupy several positions along the pin; for example, it may slide along the pin to accommodate different thicknesses of the high current conduction element; and
- a printed circuit board is housed in the plug connector and the high current conduction element is a rigid conductive bar electrically connected to the printed circuit board.

According to another embodiment of the invention, an assembly including a plug connector as described above and at least one cable electrically connected to a terminal clamped to an upper surface of the ring is also provided. Thus the majority of the current transmitted between the high current conduction element inside the plug connector and the cable passes via the ring with sufficient cross-section.

According to yet another aspect, the invention concerns a method for connecting an electrical cable external to a plug connector to a high current conduction element housed in the plug connector, wherein a conductive ring is interposed between a terminal connected to the cable and the high current conduction element, to cause an electrical current between the terminal and the high current conduction element to pass substantially through the ring, and in that the ring is housed in a cavity of the plug connector with a water-tight barrier between the ring and the plug connector. The terminal, the ring and the high current conduction element may be held and clamped together via a pin passing through them.

BRIEF DESCRIPTION OF THE SEVERAL VIEWS OF THE DRAWING

The present invention will now be described, by way of example with reference to the accompanying drawings, in which.

In these figures, the same reference numbers are used to designate identical or similar elements.

DETAILED DESCRIPTION OF THE INVENTION

Figure 1A:
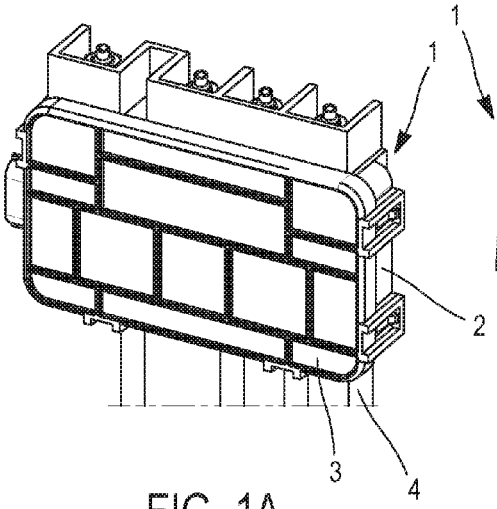
FIGS. 1A and 1B are perspective views, from two different angles respectively, of a plug connector according to one embodiment.

FIG. 1A shows a non-limiting example of an electrical plug connector 1, including a first housing member 200 and a second housing member 400. The electrical plug connector further includes two signal lines 601, 602. A CPA member (not shown) can be inserted into the first and second housing members 200, 400 of the plug connector 1 when the plug connector 1 is correctly coupled to a corresponding counter-connector (not shown).

The figures illustrate a non-limiting example of a plug connector 1 for a printed circuit board, but this type of plug connector and the arrangements described below may be applied to other plug connectors accommodating other types of devices.

Figure 1B:
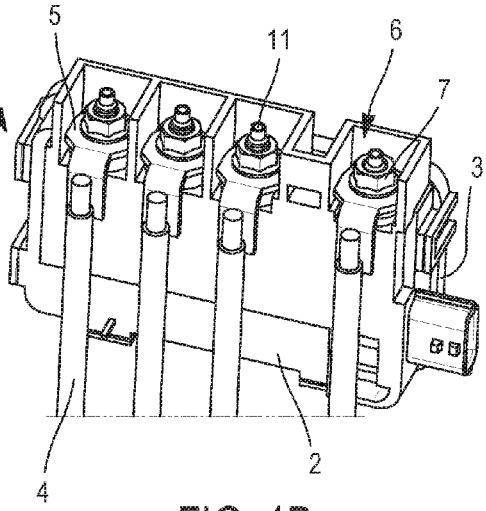

This embodiment is depicted in particular in FIGS. 1A and 1B. The plug connector 1 includes a chamber 2 closed by a cover 3.

The plug connector 1 forms part of an assembly 100 also including four cables 4, each electrically connected to a respective terminal 5. Each terminal 5 is housed in a compartment 6 of the chamber 2 in which it is held by means of a nut 7.

Figure 2:
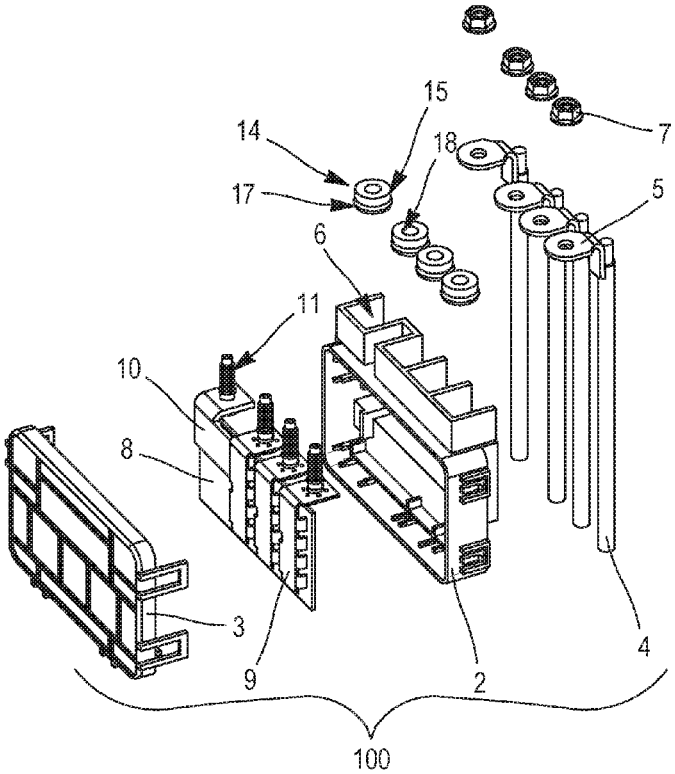
FIG. 2 are exploded perspective views of the plug connector of FIGS. 1A and 1B according to one embodiment.

As shown in FIG. 2, a printed circuit board 8 is housed in the plug connector 1. Three rigid metal bars 9 and a shunt 10, which may be generically referred to as high current conduction elements, are mounted on the printed circuit board 8 to which they are electrically connected.

A metal pin 11 is mounted on each rigid metal bar 9 and on the shunt 10. Each pin 11 includes a head 12 (see FIGS. 3 and 4) and a shank 13 with a smooth portion 13*a* (i.e. the cylindrical surface of which is smooth) and a threaded portion 13*b* (i.e. the cylindrical surface of which has a thread). The threaded portion 13*b* is located towards a longitudinal end of the shank 13 opposite the head 12.

A ring 14 is threaded onto each pin 11. Each ring 14 is made for example of brass. The ring 14 has a hollow cylindrical form; it includes a convex outer peripheral cylindrical surface 15 provided with a groove 16 accommodating an O-ring 17, a concave inner cylindrical surface 18, and also a lower surface 19 and an upper surface 20 which are flat and perpendicular to the longitudinal axis of the cylinder.

The cylindrical surface of each smooth portion 13*a* of the pin 11 includes another groove 21 accommodating another O-ring 22.

A terminal 5 and a nut 7 are also threaded onto each pin 11.

Figure 3:
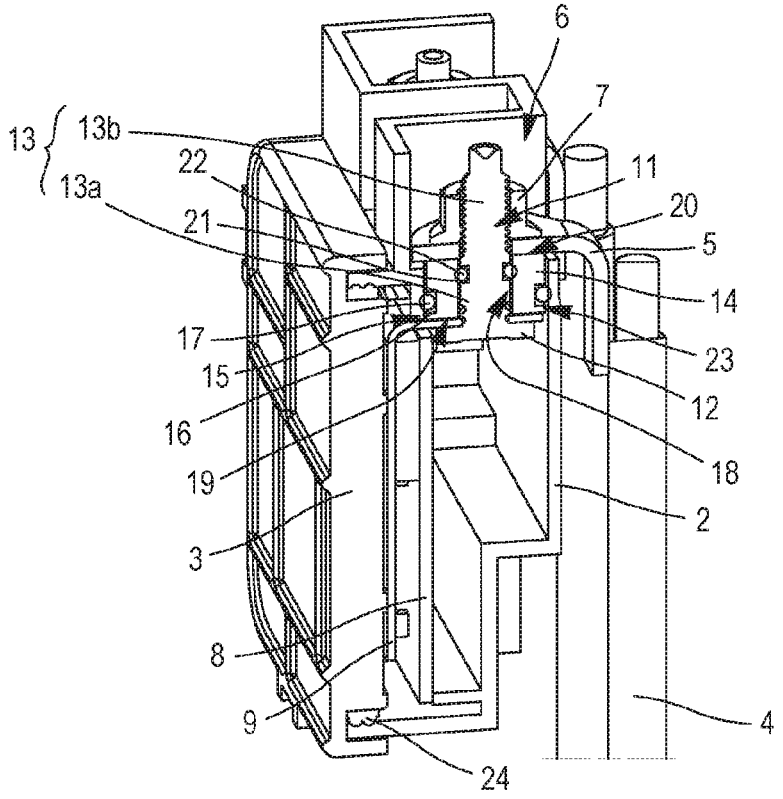
FIG. 3 is a perspective cross section view of the plug connector of FIGS. 1A, 1B, and 2.

As shown in FIG. 3, when the nut 7 is screwed tightly onto the threaded portion 13*b*, the ring 14 and the terminal 5 on one side, and the ring 14 and the rigid metal bar 9 or the shunt 10 on the other, are clamped against each other and held on each pin 11 by means of the nut 7. More precisely, the metal bar 9 or shunt 10, the ring 14 and the terminal 5 are clamped together between the head 12 of the pin 11 and the nut 7. The flat lower surface 19 and upper surface 20 of the ring 14 are each respectively in contact with a corresponding flat surface of the rigid metal bar 9 or shunt 10 on one side, and of the terminal 5 on the other. High currents can thus be conducted optimally over a large cross-section without heating.

As can also be seen in FIG. 3, each ring 14 is housed in a cavity 23 of the plug connector 1. The O-ring 17 forms a sealed barrier between the plug connector 1 and the ring 14. The O-ring 22 forms a sealed barrier between the ring 14 and the smooth portion 13*a* of the pin 11.

Also, an interfacial seal 24 ensures a seal of the plug connector 1 between the chamber 2 and the cover 3. Thus the seal of the plug connector 1 is ensured both by the O-rings 17, 22 at the rings 14, and by the interfacial seal 24.

Figure 4:
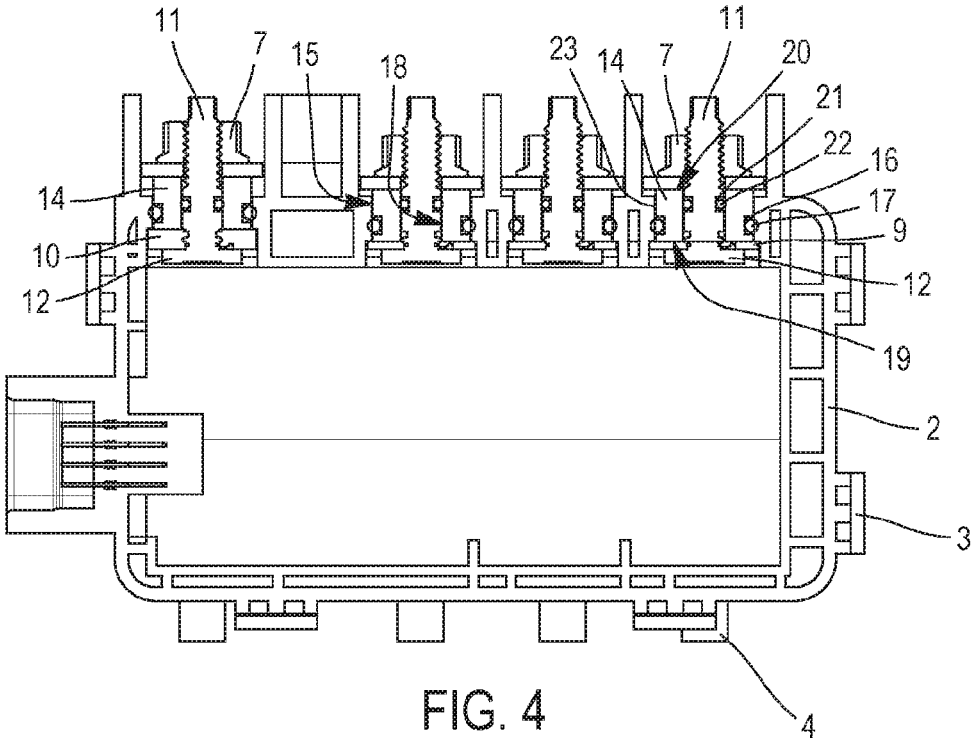
FIG. 4 is a longitudinal section view of the plug connector of the preceding figures.

As can be seen in FIG. 4, the rings 14 may be placed higher or lower in the cavities 23 along their respective pin 11, since the O-rings 17, 22 placed in their respective grooves 16, 21 maintain the seal on the cylindrical surfaces facing them. This arrangement allows accommodation of the metal bars and shunts 9, 10 of different thicknesses. The thickness of the metal bars and shunts 9, 10 may thus vary by several millimeters without the need to use different components to compensate for variations in thickness. This simplifies and reduces the cost of production and assembly of the plug connectors.

The method of connection and wiring of the plug connector 1 may include at least two stages: a first stage during which the pins 11 and the rings 14 are mounted on the plug connector 1, and a second stage, perhaps performed by another service provider, during which the cables 4 and the nuts 7 are mounted on the plug connector 1. Between the two stages, the rings are held in their respective cavities 23 thanks to the O-rings 17, 22 which apply a sufficient friction on the cylindrical surfaces facing them. Alternatively or additionally, protuberances and/or recesses on the rings 14 and/or the cavities 23 allow the rings 14 to be held in the latter.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A plug connector configured to accommodate a high current conduction element, comprising:

an electrically conductive metal ring housed in a cavity arranged in a wall of the plug connector, said ring including a lower surface oriented towards the inside of the plug connector and in electrical contact with the high current conduction element; and a water-tight barrier between an outer peripheral surface of the ring and the cavity in which it is housed, wherein the outer peripheral surface of the ring includes an outer groove accommodating a first ring seal in contact with both the ring and a surface of the plug connector, wherein the ring is threaded onto a pin which is mechanically connected to the high current conduction element, and wherein the water-tight barrier is created between an inner cylindrical surface of the ring and the pin.

2. A plug connector configured to accommodate a high current conduction element, comprising:

an electrically conductive metal ring housed in a cavity arranged in a wall of the plug connector, said ring including a lower surface oriented towards the inside of the plug connector and in electrical contact with the high current conduction element; and a water-tight barrier between an outer peripheral surface of the ring and the cavity in which it is housed, wherein the outer peripheral surface of the ring includes an outer groove accommodating a first ring seal in contact with both the ring and a surface of the plug connector, wherein the ring is threaded onto a pin which is mechanically connected to the high current conduction element, and wherein a cylindrical surface of the pin includes a groove accommodating a second ring seal in contact with both the ring and the pin.

3. A plug connector configured to accommodate a high current conduction element, comprising:

an electrically conductive metal ring housed in a cavity arranged in a wall of the plug connector, said ring including a lower surface oriented towards the inside of the plug connector and in electrical contact with the high current conduction element; and a water-tight barrier between an outer peripheral surface of the ring and the cavity in which it is housed, wherein the outer peripheral surface of the ring includes an outer groove accommodating a first ring seal in contact with both the ring and a surface of the plug connector, wherein the ring is threaded onto a pin which is mechanically connected to the high current conduction element, and wherein the pin is force-mounted on the high current conduction element.

4. The plug connector according to claim 1, 2, or 3, wherein the ring may occupy several positions along the pin.

5. A plug connector configured to accommodate a high current conduction element, comprising:

an electrically conductive metal ring housed in a cavity arranged in a wall of the plug connector, said ring including a lower surface oriented towards the inside of the plug connector and in electrical contact with the high current conduction element; and a water-tight barrier between an outer peripheral surface of the ring and the cavity in which it is housed, wherein a printed circuit board is housed in the plug connector and the high current conduction element is a rigid conductive bar electrically connected to the printed circuit board.

6. An assembly, comprising:

a plug connector configured to accommodate a high current conduction element, said plug connector including an electrically conductive metal ring housed in a cavity arranged in a wall of the plug connector and further including a water-tight barrier between an outer peripheral surface of the ring and the cavity in which it is housed, wherein the ring including a lower surface oriented towards the inside of the plug connector and in electrical contact with the high current conduction element; and at least one cable electrically connected to a terminal clamped to an upper surface of the ring.

* * * * *